US005139076A

United States Patent [19]

Langdon

[11] Patent Number: 5,139,076

[45] Date of Patent: Aug. 18, 1992

[54] DISTORTION FREE WINDOW SCREENS

[76] Inventor: Christopher D. Langdon, Box 904, 100 Braewick Rd., Tryon, N.C. 28782

[21] Appl. No.: 666,574

[22] Filed: Mar. 8, 1991

[51] Int. Cl.[5] ..... A47G 5/00

[52] U.S. Cl. ..... 160/371; 160/DIG. 7

[58] Field of Search ..... 160/371, 237, DIG. 7, 160/370.2, 354, 327; 245/2, 7, 8; 385/147; 359/591, 592, 593, 594, 595, 596, 597, 598, 893

[56] References Cited

U.S. PATENT DOCUMENTS

| | | | |
|---|---|---|---|
| 2,381,542 | 8/1945 | Hyatt et al. | 359/596 X |
| 2,665,754 | 1/1954 | Claussen et al. | 160/237 X |
| 3,255,810 | 6/1966 | Rowbottam | 160/371 X |
| 3,276,942 | 10/1966 | Ewing | 359/596 X |
| 3,321,003 | 5/1967 | Boerner | 160/237 |
| 3,480,069 | 11/1969 | Handwerker | 160/237 X |
| 3,552,476 | 1/1971 | Le Tarte | 160/371 |
| 4,084,360 | 4/1978 | Reckson | 160/371 X |
| 4,651,367 | 3/1987 | Osher et al. | 5/99.1 |
| 4,772,092 | 9/1988 | Hofer et al. | 385/147 X |
| 5,066,085 | 11/1991 | Gimbutas et al. | 245/2 X |

*Primary Examiner*—David M. Purol
*Attorney, Agent, or Firm*—John K. Donaghy

[57] ABSTRACT

An improved window screen in which each strand of the screen is substantially totally transparent is disclosed. In all cases the screen comprises a plurality of optically transparent strands with selected strands intersecting at an angle to form the screen. The strands may be woven or the strands may be bonded at their intersections to form the screen. Light passes through the strands in a distortion free manner. The strands of the screen may either be conventional optical fibers or merely of transparent plastic.

6 Claims, 1 Drawing Sheet

DISTORTION FREE WINDOW SCREENS

BACKGROUND OF THE INVENTION

1. Field of the Invention

The invention generally relates to window screens and more specifically to window screens which are essentially totally transparent and free of distortions.

2. Description Of The Prior Art

A wide variety of window screens are available in the prior art. For many years, most window screens were made of metal which would eventually rust. Additionally, the individual strands or elements of such screens were totally opaque leading to significant attenuation and distortion of light passing therethrough. These characteristic were undesirable in that they distorted the view available through windows or doors treated with such material. Conventional fiber optic cables are known to be essentially totally transparent and introduce little or no distortion to light passing therethrough. However, prior to the disclosed invention no effort had been made to take advantage of these characteristics of fiber optic bundles in forming window screens. Additionally, clear transparent strands of plastic providing similar optical advantages have not been similarly used in the prior art.

SUMMARY OF THE INVENTION

The disclosed invention comprises an improved window screen which is essentially free of the undesirable characteristics associated with prior art devices. More specifically, the preferred embodiment of the invention comprises a window screen in which each strand of the screen is substantially totally transparent. In all cases the screen comprises a plurality of optically transparent strands with selected strands intersecting at an angle to form the screen. The strands may be woven or the strands may be bonded at their intersections to form the screen. Light passes through the strands distortion free. In the preferred embodiment, the strands of the screen are conventional optical fibers. In alternate embodiments the members of the screen may be formed of transparent plastic.

DETAILED DESCRIPTION

Figure 1:
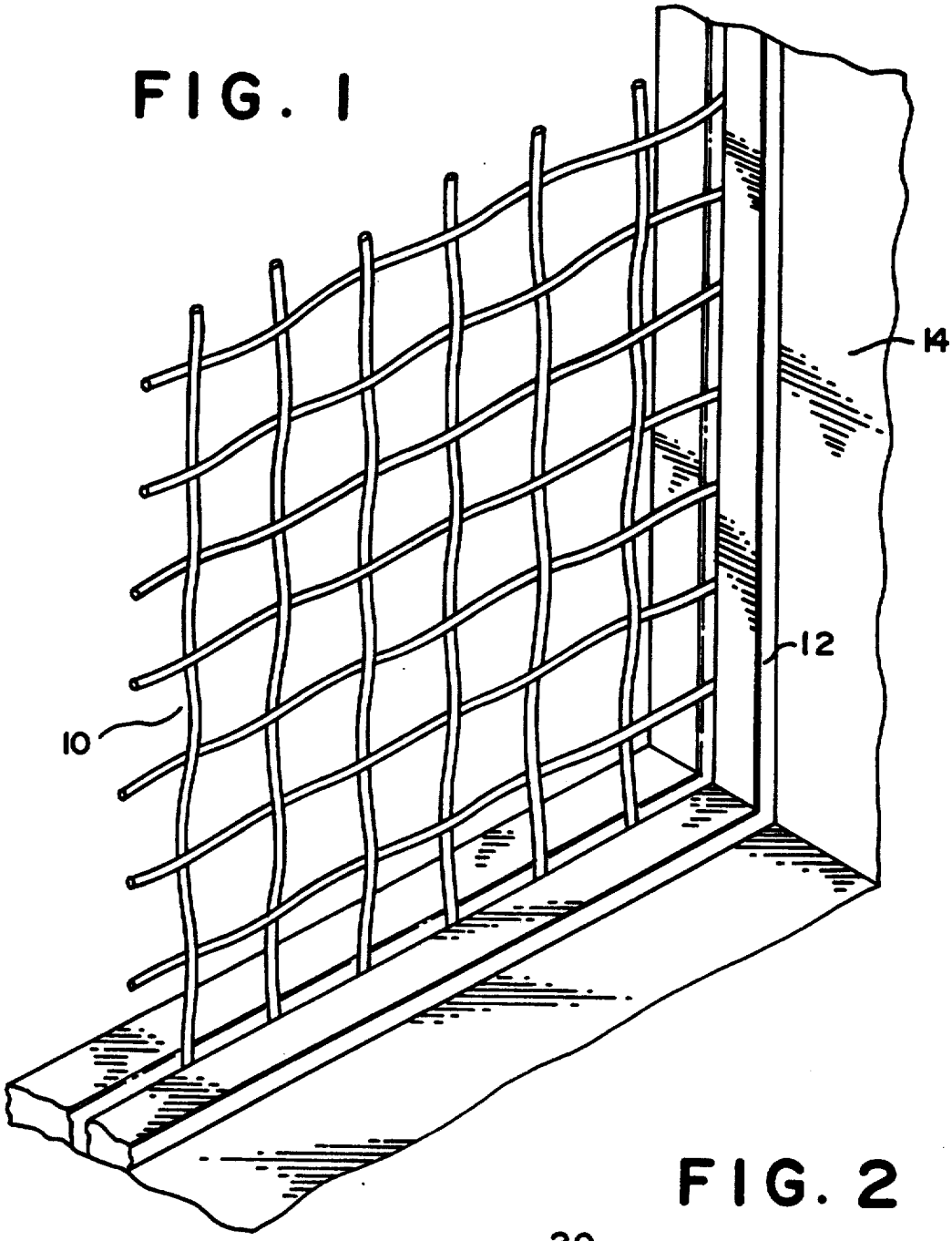
FIG. 1 is a fragmentary view of a window screen in accordance with the invention.

FIG. 1 is a fragmentary drawing of a portion of a window screen in accordance with the disclosed invention. More specifically, the screen consists of a woven arrangement or mesh with the strands comprising the mesh collectively illustrated at reference numeral 10. In use, the mesh 10 is supported on all sides by a frame 12 which holds the individual strands of the screen 10 in tension so that the mesh has a flat even appearance. The frame 10 is then attached to a wall 14 to form an opening or window covered with the screen. The screen 10 may be used in conjunction with conventional doors and windows in which case the frame 10 may be either hinged or slideable as is conventional in the prior art.

Figure 2:
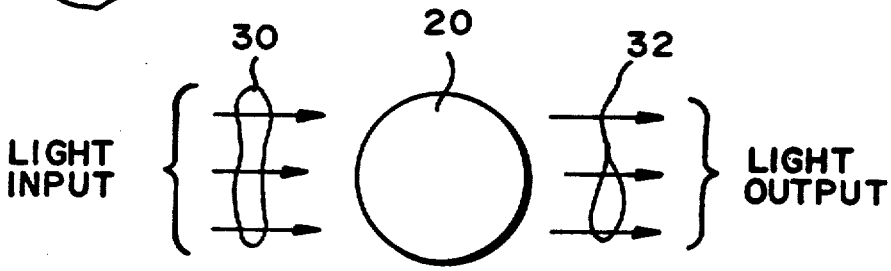
FIG. 2 is a cross-sectional view of a typical span of the window screen.

FIG. 2 specifically illustrates the operation of a typical strand 20 of the screen 10. More specifically, a light beam 30 impinges on one side of a typical strand 20 of the screen and travels therethrough to produce an output beam 32. In order for the screen to function in the desired fashion, the output beam 32 must be essentially of the same magnitude as the input beam 30 in order to prevent attenuation. Additionally, the characteristics of the input beam and output beam 30 and 32, must be essentially identical in direction, width and magnitude as the input beam in order to prevent distortion. Materials suitable for use for the strand 20 in order to achieve these results include conventional optical fibers such as glass as well as suitable strands of essentially clear distortion free plastic.

In an alternate embodiment, the strands may be positioned in a non-woven intersecting relationship to each other and bonded at the intersections of the strands to hold the strands in a fixed relationship to each other to form the screen.

I claim:

1. An improved window screen comprising a frame supporting an essentially transparent screen including a plurality of woven strands with said strands being the only elements disposed in said frame, and with each of said strands being substantially free of optical attenuation and optical distortion; said frame comprising suitable support means for maintaining said woven strands comprising said screen in tension; said transparent screen comprising a woven arrangement of elongated substantially round strands each being transparent in all planes such that all light impinging thereon passes therethrough without significant distortion of attenuation.

2. An improved window screen in accordance with claim 1 wherein said elongated elements are conventional optical fibers.

3. An improved window screen in accordance with claim 1 wherein said elongated elements are formed of transparent plastic.

4. An improved window screen comprising a frame supporting an arrangement of transparent intersecting strands bonded at their intersections, with said strands being the only elements disposed in said frame, and with each of said strands being substantially free of optical attenuation and optical distortion; said frame comprising suitable support means for maintaining said intersecting strands comprising said screen in tension; each of said intersecting strands being transparent in all planes such that light impinging thereon passes therethrough without significant distortion or attenuation.

5. An improved window screen in accordance with claim 4 wherein said elongated elements are conventional optical fibers.

6. An improved window screen in accordance with claim 4 wherein said elongated elements are formed of transparent plastic.

* * * * *